United States Patent [19]

Sassa

[11] Patent Number: 4,685,207

[45] Date of Patent: Aug. 11, 1987

[54] DEVICE FOR PULLING UP SLIDER OF A SLIDE FASTENER CHAIN

[75] Inventor: Yuusei Sassa, Toyama, Japan

[73] Assignee: Yoshida Kogyo K. K., Tokyo, Japan

[21] Appl. No.: 775,234

[22] Filed: Sep. 12, 1985

[30] Foreign Application Priority Data

Sep. 20, 1984 [JP] Japan ..... 59-141537[U]

[51] Int. Cl.[4] ..... A41H 37/06

[52] U.S. Cl. ..... 29/708; 29/33.2; 29/766

[58] Field of Search ..... 29/33.2, 408–410, 29/766–770

[56] References Cited

U.S. PATENT DOCUMENTS

| | | | |
|---|---|---|---|
| 3,093,893 | 6/1963 | Perella | 29/766 |
| 4,237,604 | 12/1980 | Swada et al. | 29/766 |
| 4,250,781 | 2/1981 | Nakamuura | 83/210 |
| 4,365,403 | 12/1982 | Ooura | 29/408 |
| 4,369,560 | 1/1983 | Uedau | 29/408 |
| 4,392,291 | 7/1983 | Iaia | 29/408 |
| 4,592,135 | 6/1986 | Kando | 29/766 |

FOREIGN PATENT DOCUMENTS

| | | | |
|---|---|---|---|
| 2158876 | 11/1985 | United Kingdom | 29/766 |

*Primary Examiner*—Howard N. Goldberg
*Assistant Examiner*—Steven Nichols
*Attorney, Agent, or Firm*—Hill, Van Santen, Steadman & Simpson

[57] ABSTRACT

A device for pulling up the slider of a slide fastener chain includes a pair of slider gripping fingers provided in opposed relation, one on each side of a slider guide groove formed in a slide fastener chain guide. The slider guide groove constitutes part of a slider passageway through which a slide fastener having a slider mounted thereon is capable of being passed and guided. The fingers are operatively associated with each other and coupled to an actuating mechanism which thrusts the fingers into the passageway to grip a slider and pull the slider up to a predetermined position as the slide fastener chain advances through the passageway, and which then withdraws the fingers from the passageway to release their grip on the slider so that the slider may pass through the passageway with the rest of the travelling fastener chain.

3 Claims, 5 Drawing Figures

DEVICE FOR PULLING UP SLIDER OF A SLIDE FASTENER CHAIN

BACKGROUND OF THE INVENTION

1. Field of the Invention

This invention relates to a slider pull-up device used in a process for manufacturing slide fasteners. More particularly, the invention relates to a device operable during the longitudinal travel of a slide fastener chain to pull a slider slidable along the chain up to a predetermined position, the slide fastener chain being in the form of a continuous strip having spaced slide fastener units provided longitudinally therealong.

2. Prior Art

A device for temporarily engaging and pulling up solely the slider of a slide fastener chain during longitudinal travel of the chain is disclosed in, for example, the specification of Japanese Patent Publication 58-17000 (U.S. Pat. No. 4,250,781). The disclosed slider pull-up device has a through-hole which permits the slide fastener chain to travel longitudinally therethrough and is provided with two horizontal fingers bracketing the through-hole and urged toward each other at all times so as to resiliently grip the slider from both sides thereof. As the slide fastener chain is moved, the slider engaged by these fingers is pulled up slidably until coming into abutting contact with a top end stop. The advancing movement of the slide fastener chain causes the slider to be forcibly freed from the fingers at the position of the top end stop so that the slider and the end stop may move past the fingers.

Since the slider is pulled up to the position of the top end stop by the conventional slider pull-up device as described, the slider is brought into close proximity to a cutting region at which the slide fastener chain is subsequently severed at a space portion thereof. As a result, the slider tends to obstruct the severence of the chain. In particular, the pull tab of the slider is likely to project into the space portion at which the cut is made, thereby making it impossible to sever the chain at the space portion.

SUMMARY OF THE INVENTION

An object of the present invention is to solve the aforementioned problem by providing a slider pull-up device in which the fingers for engaging the slider are capable of being controlled at will to terminate slider pull-up at a predetermined position before the slider abuts against the top end stop.

The predetermined position mentioned above is so selected that the pull tab of the slider will not reach the space portion even if it reclines in the direction of the space portion after the slider is pulled up.

More specifically, the present invention attains the foregoing object by providing a slider pull-up device having a pair of slider gripping fingers each of which is provided on either side of a slider guide groove in a chain guide forming a passageway which allows a slide fastener chain having a slider slidably mounted thereon to pass guidably therethrough. The fingers are operatively associated with each other and coupled to an actuating mechanism which thrusts the fingers into the passageway to grip a slider and pull the slider up to a predetermined position as the slide fastener chain advances through the passageway, and which then withdraws the fingers from the passageway to release their grip on the slider so that the slider may pass through the passageway with the rest of the travelling fastener chain.

Thus, the slider pull-up device of the present invention is adapted to project the slider gripping fingers into and withdraw them from the slider guide groove by means of the actuating mechanism so that the slider may be gripped and released at will. By operating the actuating mechanism at a preselected control schedule, the slider can be pulled up to the predetermined position before contacting the top end stop.

DETAILED DESCRIPTION

Figure 1:
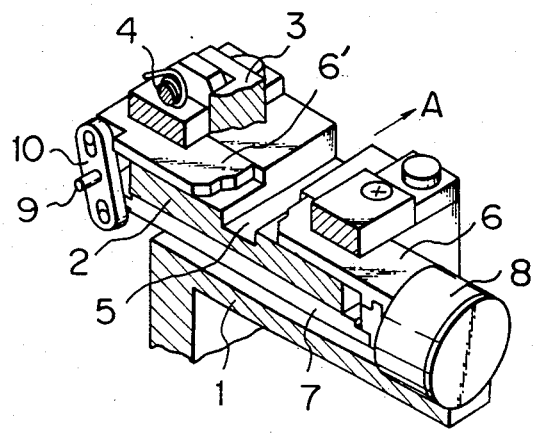
FIG. 1 is a perspective view of a slider pull-up device according to the present invention, with a principal portion thereof being shown in section.
Figure 2:
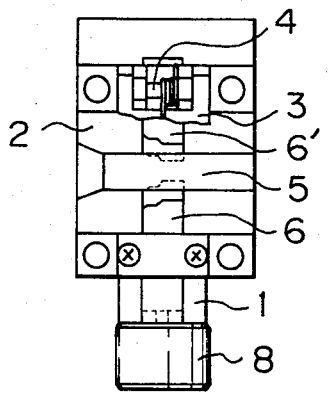
FIG. 2 is a plan view of the slider pull-up device a portion whereof is deleted.
Figure 3:
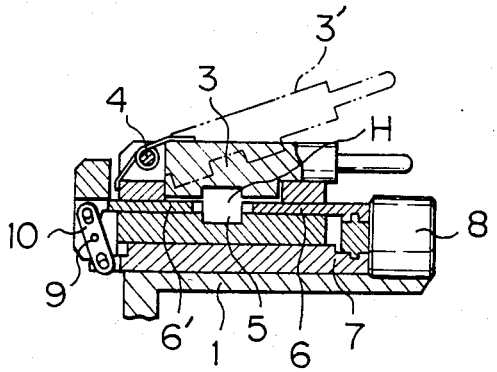
FIGS. 3 and 4 are sectional views showing operating states of the slider pull-up device.
Figure 4:
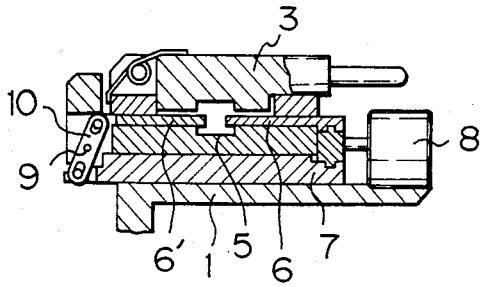

Fixedly secured to a base 1 is a chain guide plate 2 on the upper surface of which a fastener chain presser 3 is pivotally supported. The fastener chain presser 3 is urged at all times toward the base 1 by a spring 4. The chain guide plate 2 is formed to include a slider guide groove 5 for guiding a slider therethrough. A pair of fingers 6, 6' for engaging and gripping a slider therebetween are slidably mounted on the chain guide plate 2, one on each side of the slider guide groove 5. A sliding rod 7 has one end connected to the operating end of an air cylinder 8. Also connected to the operating end of the air cylinder 8 is the finger 6. A rocking lever 10 is pivotally supported on a pin 9. Loosely connected to one end of the lever 10 is the end of the finger 6' opposite the slider guide groove 5. Loosely connected to the other end of the lever 10 is the other end of the sliding rod 7. The fingers 6, 6' are thus operatively associated with each other in such a manner that actuating the air cylinder 8 causes the fingers 6, 6' to recede from both sides of the slider guide groove 5, as shown in FIG. 3, or to project into the groove 5 from both sides thereof, as shown in FIG. 4.

The chain guide plate 2 and fastener chain presser 3 form a chain guide. The upper surface of the slider guide groove 5 formed in the chain guide plate 2, the upper surfaces of the fingers 6, 6' and the lower surface of the fastener chain presser 3 define a passageway H which, as shown in FIG. 3, includes a comparatively narrow, deep, centrally located slider passage that allows the guided passage therethrough of a slide fastener chain having a slider slidably mounted thereon, and a comparatively wide, shallow tape passage provided on each side of the slider passage and communicating therewith for allowing the passage therethrough of the corresponding tape of the slide fastener chain.

Figure 5:
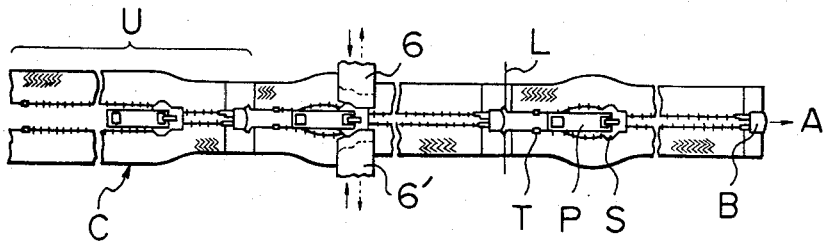
FIG. 5 is a plan view illustrating the relationship between a slide fastener chain and a pair of fingers for gripping the slider.

As shown in FIG. 5, a long slide fastener chain C, which is formed on a pair of longitudinally opposed tapes, has a plurality of slide fastener units U, U, each of which has a top end stop T, a bottom end stop or retainer B and a slider S with a pull tab P. L represents a cutting position located at a spaced portion provided between the slide fastener units U, U.

The slider pull-up device having the foregoing construction is disposed and used at a suitable position in the path of travel of the slide fastener chain C to pull the slider S up to a predetermined position. Specifically, with the pull-up device installed, the fastener chain presser 3 is raised to the position indicated by the phantom line 3' in FIG. 3 to allow the slide fastener chain to be passed guidably through the passageway H. Thereafter, the slide fastener chain C is moved in the direction of the arrow A and the air cylinder 8 is actuated so as to thrust the fingers 6, 6' forward into the slider guide groove 5, as shown in FIG. 4, thereby to engage, grip and pull up the slider S as the slide fastener chain advances. At the moment the slider S is pulled up to the predetermined position, the air cylinder 8 is actuated to operate in the reverse direction, thereby causing the fingers 6, 6' to retract from the slider guide groove 5 and, hence, release their grip on the slider S so that the slider may pass through the guide groove 5 as the slide fastener chain advances.

The slide fastener chain C having its slider S pulled up to the predetermined position in the above manner is introduced to a cutting process, where the fastener chain C is severed along the cutting line L at the space portion to separate a discrete slide fastener from the chain.

It should be noted that the air cylinder 8 in the illustrated embodiment of the invention may be substituted by other actuating means such as a hydraulic cylinder or electromagnetic solenoid.

Thus, according to the present invention, the fingers for engaging the slider are positively controlled by an actuating mechanism so as to be withdrawn from the slider to enable the slider to be pulled up to a predetermined position. This makes it possible to avoid problems when cutting the slide fastener chain C. Moreover, since the slider is not subjected to excessive force by the fingers 6, 6', the slider is not damaged or flawed.

As many apparently widely different embodiments of the present invention can be made without departing from the spirit and scope thereof, it is to be understood that the invention is not limited to the specific embodiments thereof except as defined in the appended claims.

What is claimed is:

1. A device for pulling up a slider of a long slide fastener chain formed on a pair of longitudinally opposed tapes providing a plurality of sequential slide fastener units, comprising:

a chain guide having a passageway for allowing passage therethrough of the slide fastener chain having a slider slidably mounted thereon;

a pair of slider engaging fingers arranged to oppose each other from opposite sides of the passageway for being thrust into and withdrawn from said passageway; and a finger actutating mechanism for positively thrusting said pair of fingers into the passageway and into restraining contact with a slider moving therethrough and then selectively positively withdrawing said pair of fingers from said passageway after a predetermined travel of chain.

2. The device according to claim 1, wherein said chain guide comprises a chain guide plate having a slider guide groove, and a fastener chain presser, said chain guide plate and said fastener chain presser defining said passageway, said passageway including a centrally located slider passage of a width and depth that allow passage of a slider therethrough, and a tape passage provided on each side of said slider passage and communicating therewith, said tape passage being greater in width and shallower in depth than the width and depth, respectively, of said slider passage for allowing passage of the corresponding tape therethrough.

3. The device of claim 1 wherein said slide fastener units include top stops adjacent the position selected for severance of the unit from the chain, and the withdrawing of said pair of fingers is independent of the position of the top stops.

* * * * *